US008894235B2

(12) United States Patent
Ohno et al.

(10) Patent No.: US 8,894,235 B2
(45) Date of Patent: Nov. 25, 2014

(54) ILLUMINATION DEVICE

(71) Applicant: Minebea Co., Ltd., Nagano (JP)

(72) Inventors: Yasuo Ohno, Iwata (JP); Shun Kato, Fukuroi (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 13/792,961

(22) Filed: Mar. 11, 2013

(65) Prior Publication Data

US 2013/0235589 A1 Sep. 12, 2013

(30) Foreign Application Priority Data

Mar. 12, 2012 (JP) ..... 2012-054362

(51) Int. Cl.

| | |
|---|---|
| ***F21V 1/00*** | (2006.01) |
| ***F21V 13/04*** | (2006.01) |
| ***F21V 13/02*** | (2006.01) |
| ***F21V 7/00*** | (2006.01) |
| ***F21V 7/06*** | (2006.01) |
| *F21Y 103/00* | (2006.01) |
| *F21Y 101/02* | (2006.01) |

(52) U.S. Cl.

CPC ..... *F21V 7/0066* (2013.01); *F21V 13/04* (2013.01); *F21V 13/02* (2013.01); *F21Y 2103/003* (2013.01); *F21V 7/0041* (2013.01); *F21Y 2101/02* (2013.01); *F21V 7/06* (2013.01); *F21V 7/0008* (2013.01); *F21V 7/005* (2013.01)

USPC ..... 362/217.05; 362/26

(58) Field of Classification Search

USPC ..... 362/217.05, 26, 582, 551; 353/97–99

See application file for complete search history.

(56) References Cited

U.S. PATENT DOCUMENTS

| | | | | |
|---|---|---|---|---|
| 7,040,767 | B2 * | 5/2006 | Lee et al. | 353/99 |
| 2005/0057731 | A1 * | 3/2005 | Lee et al. | 353/94 |

FOREIGN PATENT DOCUMENTS

| | | |
|---|---|---|
| JP | A-2007-294252 | 11/2007 |

* cited by examiner

*Primary Examiner* — Anne Hines

(74) *Attorney, Agent, or Firm* — Oliff PLC

(57) ABSTRACT

The illumination device includes a light source unit having a plurality of LEDs arranged in a linear shape, a light-emergent face extending to one side from the vicinity of an area straightly under the light source unit, and a first reflective body extending to the same side to which the light-emergent face extends from the vicinity of an area straightly over the light source unit, wherein the first reflection body has a first reflection face configured to get close to the light-emergent face as the first reflective body extends from the vicinity of an area straightly over the light source unit, and the light source unit is provided such that an optical axis of the LED is inclined to the first reflective face side with respect to a direction parallel to the light-emergent face.

9 Claims, 6 Drawing Sheets

ILLUMINATION DEVICE

BACKGROUND OF THE INVENTION

1. Field of the Invention

The present invention relates to an illumination device, and more particularly, to an illumination device that guides light emitted from a light source arranged in a lateral side with respect to a light-emergent face without using a solid light guide plate, and that emits the light from the light-emergent face.

2. Description of the Related Art

Conventionally, there has been proposed a light-guide-less type illumination device, in which a light source is disposed in a lateral side with respect to a light-emergent face to guide and emit the light from the light source toward the light-emergent face, and the light passes through the air without using a solid light guide plate (refer to JP 2007-294252 A, for example).

FIG. 7 illustrates an illumination device disclosed in JP 2007-294252 A. An illumination device 100 illustrated in FIG. 7 includes a reflective body 110 obtained by laminating a reflective sheet 102 on a transparent reflection panel 101, a diffusion panel 103 arranged to face the reflective body 110 and separated from the reflective body 110 with a gap, and a light source 105 arranged in one lateral side portion between the reflective body 110 and the diffusion panel 103. In addition, the reflective body 110 is bent such that a distance between the reflective body 110 and the diffusion panel 103 is gradually reduced from one lateral side portion, where the light source 105 is arranged, to the other lateral side portion. As a result, an optical path of the light emitted from the light source 105 is directed to the diffusion panel 103 side and is emitted as an illumination light.

In general, in an illumination device, a uniform illumination intensity on an illumination target surface is important. In this regard, in the illumination device 100 disclosed in JP 2007-294252 A, a reflective face 111 of the reflection panel 101 has a concave pattern including a plurality of concave portions having a pyramid shape in order to obtain a uniform illumination intensity.

SUMMARY OF THE INVENTION

However, the illumination light of the illumination device 100 contains light (hereinafter, referred to as indirect light) emitted from the diffusion panel 103 after being reflected by the reflective body 110 following emittance from the light source 105 as FIG. 7 indicates their light paths with arrows in FIG. 7. Further, the illumination light of the illumination device 100 contains light (hereinafter, also referred to as direct light) directly emitted from the diffusion panel 103 without reaching the reflection panel 101 after the light is emitted from the light source 105. The inventors made diligent investigation and found a fact that light distribution control between the direct light and the indirect light is important in order to obtain a uniform illumination intensity distribution across a wider area.

In recent years, as power efficiency is highly demanded, various illumination devices (such as an indoor light, an outdoor light, or a shelf light of a showcase or display window in a store) in which an incandescent lamp or a fluorescent lamp was employed in the past have been changed to a light-emitting diode (LED) illumination device. Typically, in the LED illumination device, a light source unit is configured by arranging a plurality of LEDs in a predetermined pattern based on a punctiform characteristic of the LED to be used as the light source. For example, in a case where the LED is employed as the light source 105 of the illumination device 100 illustrated in FIG. 7, a light source unit is configured by arranging a plurality of light sources (LEDs) 105 in a linear shape along a direction perpendicular to a paper plane of FIG. 7.

In a case where the illumination device 100 is configured as an LED illumination device in this manner, there may be a problem in that hot spots may be generated in the vicinity of an area straightly under each light source 105, and a luminance difference between the hot spots and other portions may occur flaring (glare) giving viewers unpleasant senses.

In view of the problems described above, the present invention provides an illumination device capable of obtaining a uniform illumination intensity across a wide area and alleviating a luminance difference generated by a hot spot by guiding light emitted from a plurality of light-emitting diodes without using a light guide plate.

It is noted that the following description regarding aspects of the invention is intended to exemplify structures of the present invention and will provide aspects for easy understanding in various structures of the invention. The description of each aspect is not intended to limit the scope of the invention, and any substitution, deletion, or addition for any element of each aspect may be possible by studying best modes of the invention, which are encompassed by the scope of the invention.

According to a first aspect of the invention, there is provided an illumination device including: a light source unit having a plurality of light-emitting diodes arranged in a linear shape; a light-emergent face extending to one side from the vicinity of an area straightly under the light source unit; and a first reflective body extending to the same side to which the light-emergent face extends from the vicinity of an area straightly over the light source unit, wherein the first reflective body has a first reflective face configured to get close to the light-emergent face as the first reflective body extends from the vicinity of an area straightly over the light source unit, and the light source unit is provided such that an optical axis of the light-emitting diode is inclined to the first reflective face side with respect to a direction parallel to the light-emergent face.

With this structure, it is possible to obtain excellent balance between an illumination intensity distribution caused by the light (indirect light) emitted from a light source unit, reflected on the first reflective face, and then, emitted from the light-emergent face and an illumination intensity distribution caused by the light (direct light) emitted from a light source unit and directly emitted from the light-emergent face without being reflected on the first reflective face, implement a uniform illumination intensity across a wide area, and alleviate a luminance difference caused by generation of a hot spot.

According to the first aspect, each cross section of the first reflective face formed by a plane perpendicular to the light-emergent face, which is parallel to an optical axis of the light-emitting diode, has a parabolic shape.

With this structure, it is possible to efficiently change an optical path of the light emitted from the light source unit toward the light-emergent face to improve luminance of the illumination device.

According to the first aspect, an angle defined between the light-emergent face and the optical axis of the light-emitting diode is set to 10° or larger and 30° or smaller.

With this structure, it is possible to optimize balance between indirect light and direct light, obtain a uniform illumination intensity distribution across a wide range, and more effectively alleviate a luminance difference caused by generation of a hot spot.

According to the first aspect, the illumination device further includes a second reflective body extending from the vicinity of an area straightly under the light source unit over the light-emergent face to the same side to which the light-emergent face extends, wherein the second reflective body has a second reflective face configured to get close to the light-emergent face as the second reflective body extends from the vicinity of an area straightly under the light source unit.

With this structure, it is possible to more effectively alleviate a luminance difference caused by a hot spot generated in the vicinity of an area straightly under each light-emitting diode.

According to the first aspect, the illumination device further includes a side wall where the light source unit is fixed, and the first reflective body, the side wall, and the second reflective body are formed in a single integrated body through extrusion molding.

With this structure, it is possible to easily and inexpensively form a structure having a first reflective body, a side wall, and a second reflective body with a desired cross-sectional shape.

According to the first aspect, the illumination device further includes any one or both of a diffusion/reflection layer that is provided in the first reflective face and has reflectance higher than that of the first reflective body and a diffusion/reflection layer that is provided in the second reflective face and has reflectance higher than that of the second reflective body.

With this structure, it is possible to improve uniformity of the illumination intensity and luminance, compared to a case where the diffusion/reflection layer is not provided in both the first and second reflective face.

According to the first aspect, the illumination device further includes a diffusion panel, wherein one surface of the diffusion panel constitutes the light-emergent face.

With this structure, it is possible to improve uniformity of the illumination intensity by diffusing the light emitted from the illumination device.

According to a second aspect of the invention, there is provided an illumination device including: a light source unit having a plurality of light-emitting diodes arranged in a linear shape; a light-emergent face extending to one side from the vicinity of an area straightly under the light source unit; a first reflective body extending to the same side to which the light-emergent face extends from the vicinity of an area straightly over the light source unit, the first reflective body having a first reflective face configured to get close to the light-emergent face as the first reflective body extends from the vicinity of an area straightly over the light source unit; and a second reflective body extending the same side to which the light-emergent face extends from the vicinity of an area directly under the light source unit over the light-emergent face, the second reflective body having a second reflective face configured to get close to the light-emergent face as the second reflective body extends from the vicinity of an area straightly under the light source unit.

With this structure, since the second reflective body extends to the same side to which the light-emergent face extends from the vicinity of an area straightly under the light source unit over the light-emergent face, and the second reflective body has a second reflective face configured to get close to the light-emergent face as the second reflective body extends from the vicinity of an area straightly under the light source unit, it is possible to effectively alleviate a luminance difference caused by a hot spot generated in the vicinity of an area straightly under each light-emitting diode.

According to the present invention, in an illumination device where the light emitted from a plurality of light-emitting diodes is guided and emitted without using a light guide plate, it is possible to obtain a uniform illumination intensity across a wide range and alleviate or eliminate a luminance difference caused by generation of a hot spot.

DETAILED DESCRIPTION OF THE PREFERRED EMBODIMENTS

Hereinafter, embodiments of the present invention will be described with reference to the accompanying drawings. It is noted that each drawing illustrating the illumination device (FIGS. 1 and 4) are schematic diagrams illustrating only the main elements thereof. Therefore, the illumination device according to each embodiment of the present invention may include other non-illustrated components, and a relative dimension of each illustrated part may be enlarged or reduced for description purposes. Therefore, it does not necessarily reflect an actual scale.

Figure 1:
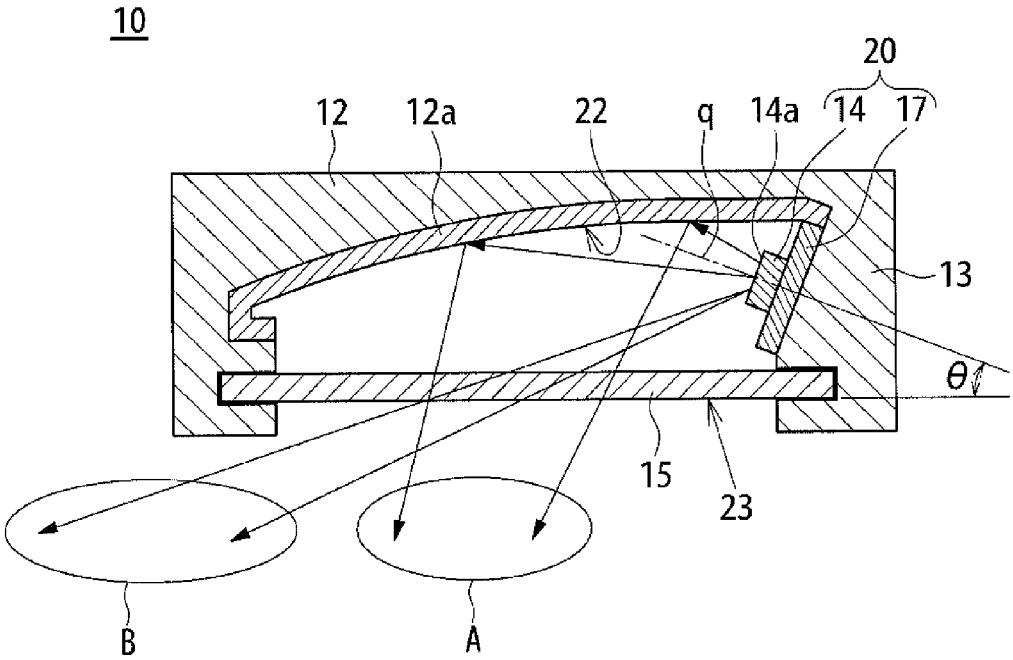
FIG. 1 is a cross-sectional view illustrating main elements of an illumination device according to a first embodiment of the present invention.

An illumination device 10 according to a first embodiment of the present invention includes a light source unit 20 having a plurality of light-emitting diodes (hereinafter, also referred to as LEDs) 14 arranged in a linear shape. FIG. 1 is a cross-sectional view of the illumination device 10 illustrating one of the LEDs 14 taken along a line perpendicular to an arrangement direction of the LEDs 14.

The illumination device 10 further includes a diffusion panel 15 arranged to extend to one side (left side in FIG. 1) from the vicinity of an area straightly under the light source unit 20, a first reflective body 12 arranged to extend to the same side to which a light-emergent face 23 extends from the vicinity of an area straightly over the light source unit 20, and a side wall 13 where the light source unit 20 is fixed. The light-emergent face 23 of the illumination device 10 includes a lower face (principal face directed to the outer side of the device) of the diffusion panel 15. As a result, the light-emergent face 23 extends from the vicinity of an area straightly under the light source unit 20 to the one side.

Here, a direction perpendicular to the light-emergent face 23 refers to a vertical direction (vertical direction in FIG. 1). With respect to the vertical direction, a direction from the light source unit 20 to the light-emergent face 23 refers to a downward direction (downward direction in FIG. 1), and a direction from the light source unit 20 to the first reflective body 12 refers to an upward direction (upward direction in FIG. 1). It is noted that such a setting of the vertical direction of the illumination device 10 is not intended to limit an actual vertical direction for mounting the illumination device 10 in various applications of the illumination device 10.

In addition, a direction parallel to the light-emergent face 23 and perpendicular to the arrangement direction of the LEDs 14 in the illumination device 10 refers to a back-and-forth direction (horizontal direction in FIG. 1). With respect to the back-and-forth direction, a direction extending from the vicinity of an area straightly under the light source unit 20 to the light-emergent face 23 refers to a forward direction (left direction in FIG. 1).

Furthermore, the arrangement direction (direction perpendicular to the paper plane of FIG. 1) of the LEDs 14 in the illumination device 10 refers to a width direction, and an extension of the illumination device 10 in the width direction refers to a width.

The side wall 13 in the illumination device 10 is provided between an end portion of the first reflective body 12 in the vicinity of an area straightly over the light source unit 20 and an end portion of the light-emergent face 23 in the vicinity of an area straightly under the light source unit 20.

Each LED 14 of the light source unit 20 is configured to emit light from a light-emergent face 14*a* with a predetermined light distribution with respect to an optical axis q. The light source unit 20 is fixed to the side wall 13 such that the light-emergent face 14*a* of each LED 14 is directed to a space formed between the first reflective body 12 and the diffusion panel 15. In the light source unit 20, the optical axis q of each LED 14 is perpendicular to the arrangement direction of the LEDs 14 and is included in a cross section of FIG. 1 (and a cross section parallel to the cross section of FIG. 1).

As illustrated in FIG. 1, the light source unit 20 includes a circuit board 17 for supplying a driving current to each LED 14. The circuit board 17 where each LED 14 is mounted may be arranged and fixed to the side wall 13.

In the illumination device 10, the first reflective body 12 is curved to get close to the light-emergent face 23 as it extends from the vicinity of an area straightly over the light source unit 20. In addition, a first reflective face 22 corresponds to a surface (a surface facing the inside of the device) of the first reflective body 12 curved in this manner facing the diffusion panel 15. As a result, the first reflective face 22 is configured to get close to the light-emergent face 23 as it extends from the vicinity of an area straightly over the light source unit 20. In addition, in the illumination device 10, the first reflective body 12 is formed to be curved such that the cross section of FIG. 1 and an arbitrary cross section parallel to the cross section of FIG. 1 (in other words, each cross section of the first reflective face 22 formed by a plane perpendicular to the light-emergent face 23, which is parallel to the optical axis q of the LED 14) has a parabolic shape.

In the illumination device 10, the first reflective body 12 and the side wall 13 are made of an aluminum material as a single integrated body obtained through extrusion molding and constitute a part of a casing for holding elements of the illumination device 10 including the light source unit 20 and the diffusion panel 15. In addition, the first reflective face 22 is provided with a diffusion/reflection layer 12*a* made of a white reflective material having reflectance higher than that of the aluminum material (for example, reflectance of 95% or higher). In the following description, reflection on the first reflective face 22 usually means reflection on this diffusion/reflection layer 12*a*.

In the illumination device 10, the light source unit 20 is provided such that the optical axis q of each LED 14 of the light source unit 20 is inclined to the first reflective face 22 side with respect to a direction parallel to the light-emergent face 23. In this case, an angle θ (hereinafter, also referred to as an installation angle) of the optical axis q with respect to the light-emergent face 23 is preferably set to 10° or higher and 30° or lower, and more preferably, 10° or higher and 20° or lower.

In the illumination device 10 of FIG. 1 having the aforementioned configuration, a space between the first reflective face 22 and the diffusion panel 15 serves as an optical path. As a result, after light is emitted from the light source unit 20, a part thereof is reflected on the first reflective face 22 and is emitted from the light-emergent face 23 (indirect light). In addition, another part thereof is directly emitted from the light-emergent face 23 without being reflected by the first reflective face 22 (direct light). Using mixed light of the indirect light and the direct light, an illumination target surface (not illustrated) under the illumination device 10 is illuminated mainly across a wide range from the area straightly under the light-emergent face 23 to the forward direction. FIG. 1 schematically illustrates an exemplary optical path of the indirect light A and an exemplary optical path of the direct light B using an arrow.

Next, effects of the illumination device 10 will be described with reference to FIGS. 2, 3A, and 3B.

Figure 2:
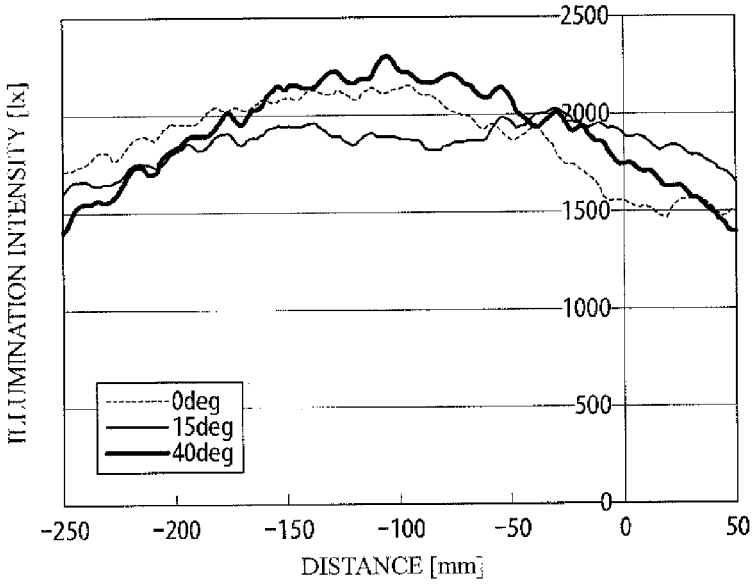
FIG. 2 is a graph illustrating an illumination intensity distribution on an illumination target surface of the illumination device of FIG. 1 along with a comparative example.

FIG. 2 is a graph illustrating a illumination intensity [1×] on a straight line extending in a back-and-forth direction passing through the area straightly under the center of the light source unit 20 in a width direction on an illumination target surface provided under 30 cm of the light-emergent face 23 of the illumination device 10 according to the present embodiment along with a comparative example. Plots of 0 deg, 15 deg, and 40 deg illustrated in FIG. 2 illustrate an illumination intensity distribution of the illumination device when the installation angle θ of the LED 14 is set to 0°, 15°, and 40°, respectively. The plot for the installation angle of 0° corresponds to an illumination intensity distribution in the illumination device of the related art. The plots for the installation angles of 15° and 40° correspond to the illumination intensity distributions of the illumination device 10 according to the present embodiment.

The abscissa of FIG. 2 denotes a distance [mm] on the illumination target surface obtained by setting a point straightly under the center in the width direction of the light source unit 20 to zero, where a negative direction corresponds to a forward direction, and a positive direction corresponds to a backward direction. The illumination device in the comparative example has a configuration similar to that of the illumination device 10 except that the installation angle θ of the LED 14 is set to 0°.

Referring to FIG. 2, it is recognized that, in the illumination device 10 according to the present embodiment, the illumination intensity significantly increases in the point straightly under the light source unit 20 (distance=0 mm) in a case where the installation angle of the LED 14 is set to 15°, compared to a case where the installation angle is set to 0°. In addition, it is also recognized that uniformity of the illumination intensity distribution in the forward direction from the zero position (distance=0 mm) is obviously improved.

Meanwhile, in the illumination device 10 according to the present embodiment, the illumination intensity in the point straightly under the light source unit 20 (distance=0 mm) increases in a case where the installation angle of the LED 14 is set to 40°, compared to a case where the installation angle is set to 0°. However, it is difficult to say that uniformity of the illumination intensity distribution is improved in the forward direction from the zero position (distance=0 mm). In addition, compared to a case where the installation angle of the LED 14 is set to 15°, the uniformity tends to be degraded.

Therefore, in the illumination device 10 according to the present embodiment, the installation angle of the LED 14 is preferably set to 10° or higher and 30° or lower from the viewpoint of uniformity in the illumination intensity distribution. More preferably, the installation angle of the LED 14 is set to 10° or higher and 20° or lower in consideration of a fact that the characteristic is more excellent in a case where the installation angle 15 is set to 15°.

It is noted that the illumination device 10 according to the present embodiment is designed to have a certain level of the effect even when the installation angle of the LED 14 is set to, approximately, 40.degree. Next, the effect of the illumination device 10 will be described with reference to FIGS. 3A and 3B from the viewpoint of balance between the indirect light A and the direct light B. Here, FIGS. 3A and 3B illustrate illumination intensity distributions on the illumination target surface similar to that of the graph of FIG. 2 by classifying into the illumination intensity caused by the indirect light A (FIG. 3A) and the illumination intensity caused by the direct light B (FIG. 3B).

Figure 3A:
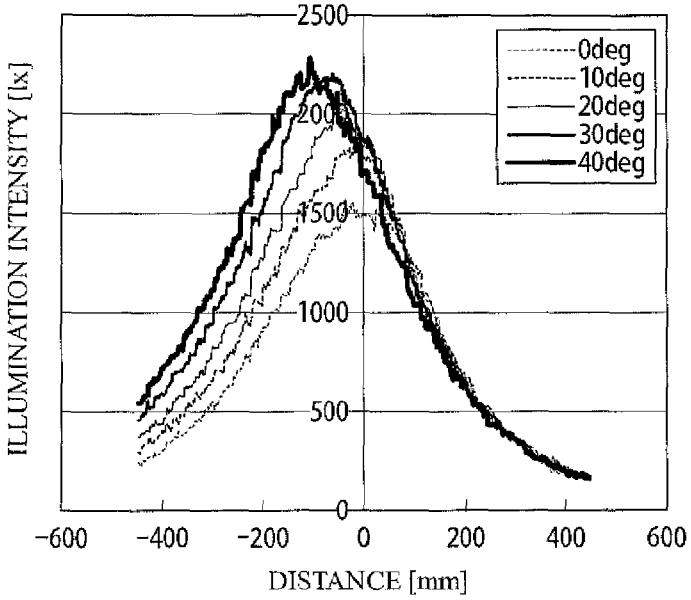
FIG. 3A is a graph illustrating an illumination intensity distribution of indirect light on an illumination target surface of the illumination device of FIG. 1 along with a comparative example.
Figure 3B:
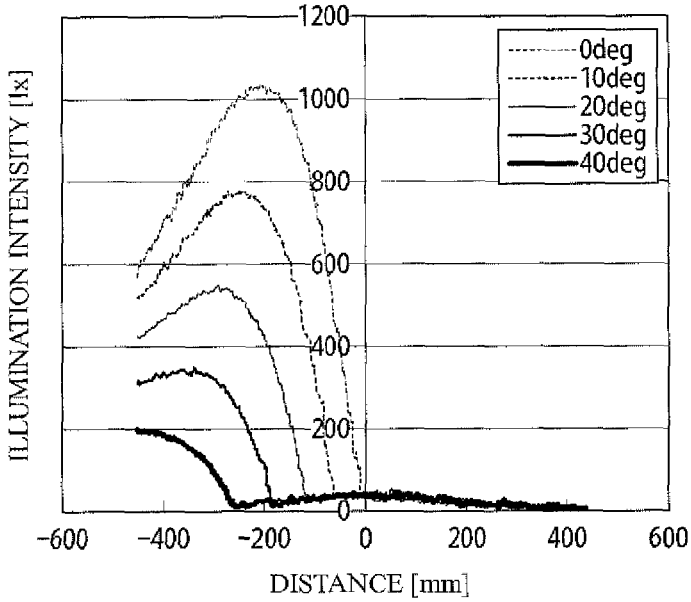
FIG. 3B is a graph illustrating an illumination intensity distribution of direct light on an illumination target surface of the illumination device of FIG. 1 along with a comparative example.

Referring to FIGS. 3A and 3B, it is recognized that, generally, the illumination intensity caused by the indirect light A increases (FIG. 3A), and the illumination intensity caused by the direct light B decreases (FIG. 3B) as the installation angle θ increases. Therefore, in the illumination device 10 according to the present embodiment in which the installation angle of the LED 14 is set to 10°, 20°, 30°, and 40°, it is possible to alleviate the luminance difference generated by a hot spot due to the direct light B from the LED 14 and reduce glare feelings in any case, compared to the illumination device of the related art in which the installation angle of the LED 14 is set to 0°.

Here, although the illumination device 10 according to the present embodiment is not limited by its utilization, the illumination device 10 according to the present embodiment is preferably used as, for example, a so-called shelf lighting device in consideration of a fact that the illumination device 10 generally illuminates the illumination target surface located thereunder across a wide range from the area straightly under the light-emergent face 23 to the forward direction. The shelf lighting device is used to uniformly illuminate the entire underlying shelf by installing the shelf lighting device to a near side (or far side) of a lower face of a shelf of a showcase for displaying products in a store and the like such that a direction from the near side to the far side (or a direction from the far side to the near side) corresponds to a forward direction of the illumination device 10.

Referring to the illumination intensity distribution caused by the direct light B in FIG. 3B from the viewpoint of utilization as such a shelf lighting device, it is recognized that a peak of the illumination intensity caused by the direct light B moves forward as the installation angle θ of the LED 14 increases. Therefore, in a case where the illumination device 10 is used as a shelf lighting device, a peak of the illumination intensity caused by the direct light B moves to the far side of the showcase by installing the illumination device 10 in the near side (instead of the far side) on a lower face of the shelf such that a direction from the near side to the far side corresponds to the forward direction of the illumination device 10. Therefore, it is possible to achieve illumination light with reduced glare feelings for a customer who sees the product displayed on a showcase by effectively using the characteristic of the illumination device 10 according to the present embodiment illustrated in FIGS. 3A and 3B.

Here, although it is assumed that the illumination device 10 of FIG. 1 includes the diffusion panel 15, and the lower face thereof constitutes the light-emergent face 23, the illumination device 10 may also have a structure in which the space serving as a light guide path is opened to the downward direction without using the diffusion panel 15. The light-emergent face 23 may be defined as a virtual design surface extending to one side from the vicinity of an area straightly under the light source unit 20. This configuration is advantageous in that loss of the illumination light can be reduced, and the luminance of the illumination device 10 can be improved.

Next, an illumination device 40 according to a second embodiment of the present invention will be described with reference to FIG. 4. It is noted that the illumination device 40 is similar to the illumination device 10 of FIG. 1 except for a second reflective face 55. Therefore, the following description will be generally given for a difference between the illumination devices 10 and 40 without repeating the description of similar parts.

Figure 4:
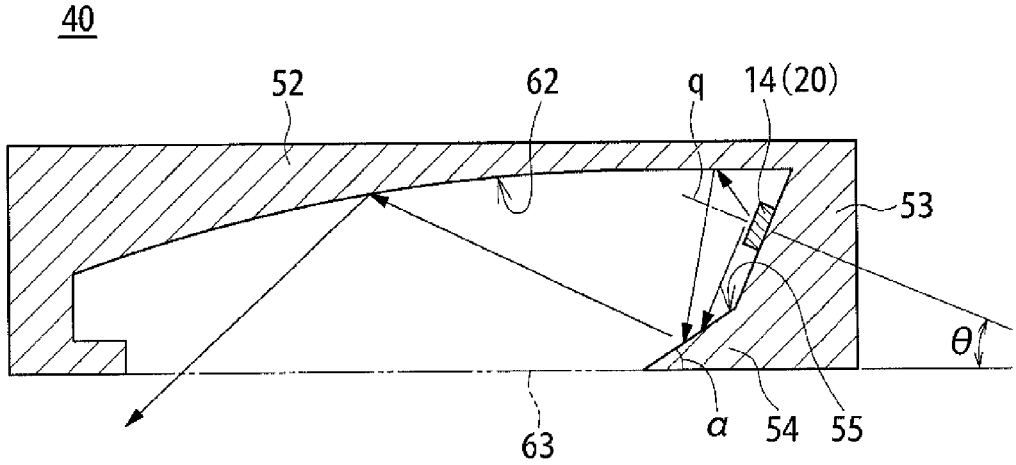
FIG. 4 is a cross-sectional view illustrating main elements of an illumination device according to a second embodiment of the present invention.

Referring to FIG. 4, in the illumination device 40, a light-emergent face 63 is defined as a virtual design surface extending to one side (left side in FIG. 4) from the vicinity of an area straightly under the light source unit 20 (the circuit board 17 is not illustrated intentionally) by way of example. However, the illumination device 40 may include the diffusion panel 15 similar to that of the illumination device 10.

The illumination device 40 according to the present embodiment further includes a second reflective body 54 extending to the same side to which the light-emergent face 63 (left side in FIG. 4) extends from the vicinity of an area straightly under the light source unit 20 over the light-emergent face 63. This second reflective body 54 includes the second reflective face 55 configured so as to get close to the light-emergent face 63 as it extends from the vicinity of an area straightly under the light source unit 20. Therefore, the illumination device 40 is different from the illumination device 10.

Here, in the illumination device 40 of FIG. 4, a first reflective body 52 and a side wall 53 are made of an aluminum material as a single integrated body obtained through extrusion molding, similar to the first reflective body 12 and the side wall 13 of FIG. 1. In addition, in the illumination device 40, the second reflective body 54 is also formed in a single body integrated with the first reflective body 52 and the side wall 53 as a claw portion connected to the side wall 53.

In the example of FIG. 4, the claw portion (second reflective body) 54 is formed to have the second reflective face 55 as an inclined face having a certain inclination angle (for example, 35°) with respect to the light-emergent face 63.

In the illumination device 40, a diffusion/reflection layer (not illustrated) made of a white reflective material having reflectance (for example, 95% or higher) higher than that of an aluminum material is provided in both or any one of a first reflective face 62 and the second reflective face 55. In a case where the diffusion/reflection layer is provided in the first or second reflective face 62 or 55, reflection on the first or second reflective face 62 or 55 in the following description generally means reflection on this diffusion/reflection layer.

In the illumination device 40 configured in this manner, the indirect light and the direct light emitted from the light source unit 20 and directed to the vicinity of an area straightly under the light source unit 20 are not directly emitted from the vicinity of an area straightly under the light source unit 20 of the light-emergent face 63. Instead, the indirect light and the direct light are reflected on the second reflective face 55, sent to the forward direction, reflected on the first reflective face 52, and then emitted from the light-emergent face 63.

As a result, it is possible to more effectively suppress generation of a hot spot in the vicinity of an area straightly under the light source unit 20 and more effectively alleviate a luminance difference caused by a hot spot.

An effect of alleviating the luminance difference will be described as follows with reference to FIG. 5.

Figure 5:
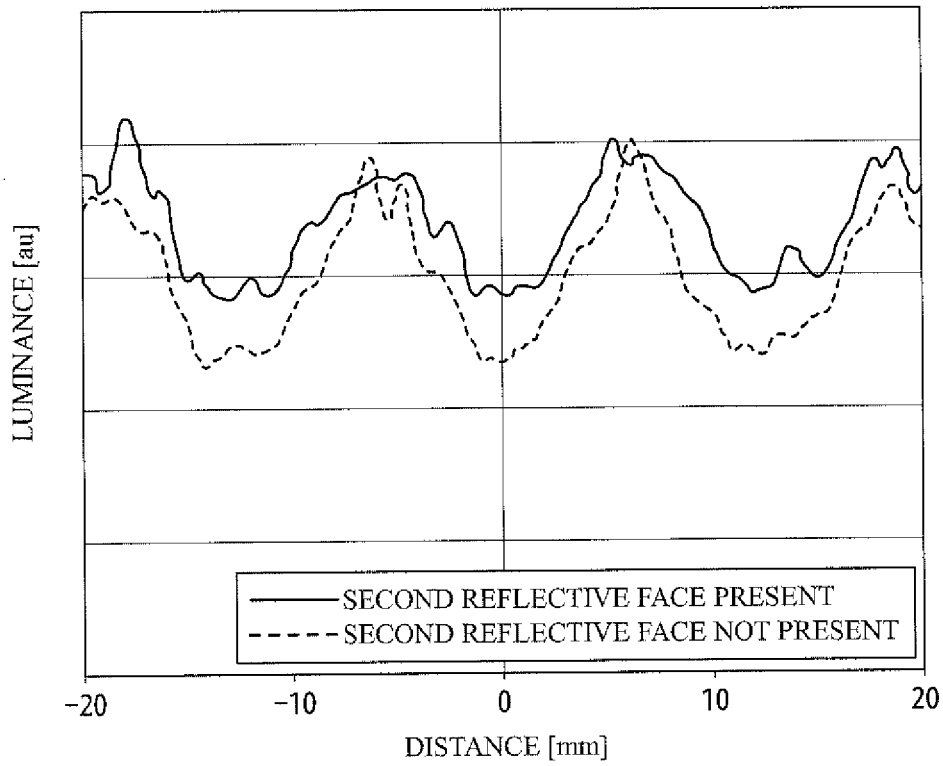
FIG. 5 is a graph illustrating a luminance distribution depending on a position of a light source unit of the illumination device of FIG. 4 in comparison with the luminance distribution similar to that of the illumination device of FIG. 1.

FIG. 5 is a graph illustrating a luminance distribution in a width direction on a portion of each of the light-emergent faces 23 and 63 closest to the light source unit 20 side in the illumination device 40 according to the present embodiment having the second reflective face 55 and the illumination device 10 according to the first embodiment that does not have the second reflective face 55 (where the LED 14 is installed at a predetermined installation angle θ). In FIG. 5, the abscissa denotes a distance [mm] in a width direction of the light source unit 20 (where the center of the width direction is set to zero), and the ordinate denotes luminance represented in arbitrary unit.

In any one of the illumination devices 10 and 40, the installation angle θ of the LED 14 was set to 20°, and the inclination angle α of the second reflective face 55 with respect to the light-emergent face 63 in the illumination device 40 was set to 35°.

Referring to FIG. 5, it is recognized that, in the illumination device 40 having the second reflective face 55, the luminance difference in a position of the light source unit 20 is alleviated, compared to the illumination device 10 that does not have the second reflective face 55.

An effect of the second reflective face 55 for sending, to the forward direction, the indirect light and the direct light emitted from the light source unit 20 to the vicinity of an area straightly under the light source unit 20 will be described as follows with reference to FIG. 6.

Figure 6:
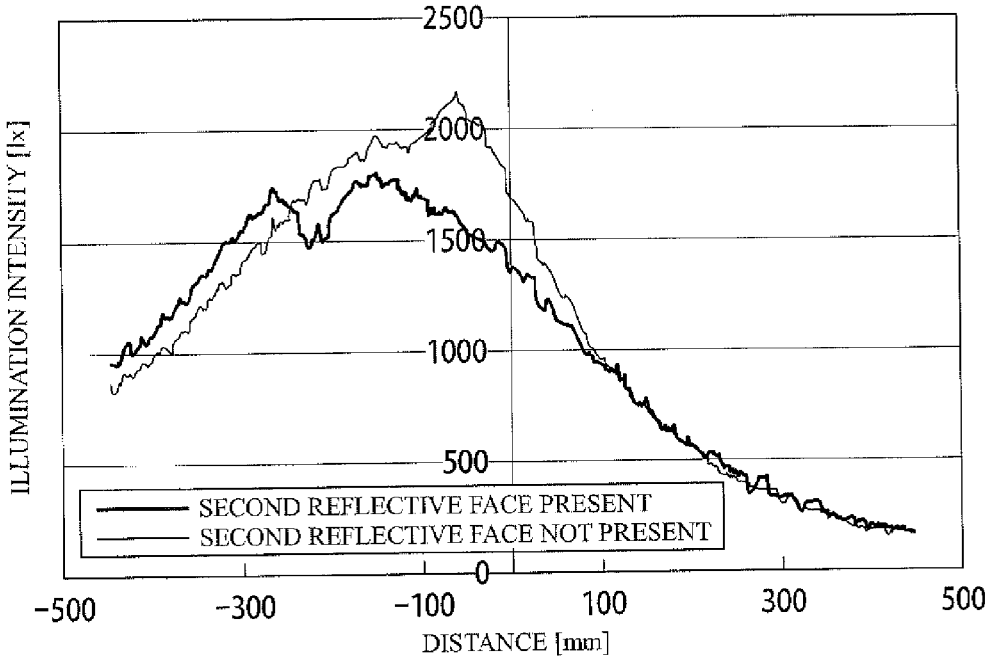
FIG. 6 is a graph illustrating an illumination intensity distribution on an illumination target surface of the illumination device of FIG. 4 in comparison with the illumination intensity distribution similar to that of the illumination device of FIG. 1.
Figure 7:
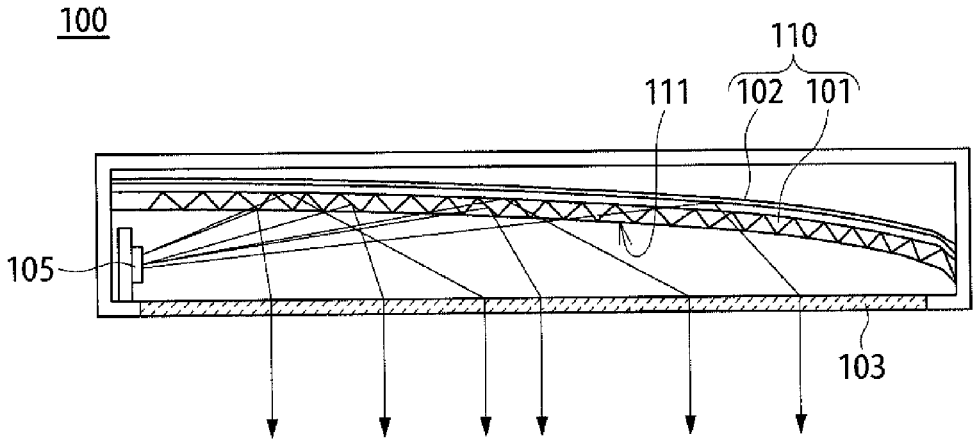
FIG. 7 PRIOR ART
FIG. 7 is a cross-sectional view illustrating an exemplary light guide-less type illumination device of the related art.

FIG. 6 is a graph illustrating an illumination intensity distribution similar to that of FIG. 2 for the illumination device 40 according to the present embodiment having the second reflective face 55 and the illumination device 10 according to the first embodiment that does not have the second reflective face 55 (where the LED 14 is installed at a predetermined installation angle θ). In this case, the diffusion panel is not provided in any illumination device.

Referring to FIG. 6, it is recognized that, in the illumination device 40 having the second reflective face 55, the illumination intensity distribution thereof including the peak position moves forward as a whole, compared to the illumination device 10 that does not have the second reflective face 55.

The characteristic of the illumination device 40 is advantageous in that the illumination area is further widened. In addition, as in the shelf lighting device described above, the illumination device 40 is advantageous in that glare feelings can be further reduced by arranging the illumination device 40 such that a viewer is positioned in the light source unit 20 side.

In the illumination device 40 illustrated in FIG. 4, similar to the illumination device 10 illustrated in FIG. 1, the light source unit 20 is provided such that the optical axis q of the LED 14 is inclined to the first reflective face 62 side with respect to a direction parallel to the light-emergent face 63. As a result, it is possible to obtain the same effect as that of the illumination device 10.

It is noted that, in the illumination device according to the present invention having the second reflective face 55, the light source unit 20 may be provided such that the optical axis q of the LED 14 is oriented to a direction parallel to the light-emergent face 63 (installation angle θ=0°). Even in this case, it is possible to obtain the same effect as that described above with reference to FIGS. 5 and 6.

Although the present invention has been described based on the preferable embodiments hereinbefore, a sheet-like illumination device according to the present invention is not limited to the embodiments described above.

For example, although the description has been made by assuming that the first reflective faces 22 and 62 of the illumination devices 10 and 40 are curved such that the cross section of FIG. 1 has a parabolic shape, the first reflective faces 22 and 62 may have any suitable shape depending on a specification desired in the illumination devices 10 and 40 as long as the first reflective faces 22 and 62 are configured to get close to the light-emergent faces 23 and 63, respectively, as they extend from the vicinity of an area straightly over the light source unit 20. For example, the first reflective faces 22 and 62 may be an inclination face inclined at a predetermined angle with respect to the light-emergent faces 23 and 63, respectively.

The second reflective face 55 in the illumination device 40 may be curved in an arbitrary shape as long as the second reflective face 55 is configured so as to get close to the light-emergent face 63 as it extends from the vicinity of an area straightly under the light source unit 20.

What is claimed is:

1. An illumination device comprising:

a light source unit having a plurality of light-emitting diodes arranged in a linear shape;

a light-emergent face extending to one side from a vicinity of an area straightly under the light source unit; and a first reflective body extending to the same side to which the light-emergent face extends from a vicinity of an area straightly over the light source unit, wherein the first reflective body has a first reflective face configured to be closer to the light-emergent face as the first reflective body extends from the vicinity of the area straightly over the light source unit, and the light source unit is provided such that an optical axis of the light-emitting diode is inclined to the first reflective face with respect to a direction parallel to the light-emergent face, the light source unit configured to allow indirect light reflected from the first reflective body and direct light not reflected from the first reflective body to be concurrently emitted from the light-emergent face.

2. The illumination device according to claim 1, wherein each cross section of the first reflective face formed by a plane perpendicular to the light-emergent face, which is parallel to the optical axis of the light-emitting diode, has a parabolic shape.

3. The illumination device according to claim 1, wherein an angle defined between the light-emergent face and the optical axis of the light-emitting diode is set to 10° or larger and 30° or smaller.

4. The illumination device according to claim 1, further comprising a diffusion panel, wherein one surface of the diffusion panel forms the light-emergent face.

5. The illumination device according to claim 1, wherein the direct light travels farther away from the light source unit than the indirect light, in a light traveling direction, to reach an illumination target surface under the illumination device.

6. An illumination device comprising:

a light source unit having a plurality of light-emitting diodes arranged in a linear shape;

a light-emergent face extending to one side from a vicinity of an area straightly under the light source unit;

a first reflective body extending to the same side to which the light-emergent face extends from a vicinity of an area straightly over the light source unit, wherein the first reflective body has a first reflective face configured to be closer to the light-emergent face as the first reflective body extends from the vicinity of the area straightly over the light source unit, and the light source unit is provided such that an optical axis of the light-emitting diode is inclined to the first reflective face with respect to a direction parallel to the light-emergent face, and a second reflective body that extends from the vicinity of the area straightly under the light source unit over the light-emergent face to the same side to which the light-emergent face extends, wherein the second reflective body has a second reflective face configured to get close be closer to the light-emergent face as the second reflective body extends from the vicinity of the area straightly under the light source unit.

7. The illumination device according to claim 6, further comprising a side wall where the light source unit is fixed, and the first reflective body, the side wall, and the second reflective body are formed in a single integrated body by extrusion molding.

8. The illumination device according to claim 6, further comprising at least one of (i) a diffusion/reflection layer provided in the first reflective face, the diffusion/reflection a reflectance higher than a reflectance of the first reflective body and (ii) a diffusion/reflection layer provided in the second reflective face, the diffusion/reflection layer having a reflectance higher than a reflectance of the second reflective body.

9. An illumination device comprising:

a light source unit having a plurality of light-emitting diodes arranged in a linear shape;

a light-emergent face extending to one side from a vicinity of an area straightly under the light source unit;

a first reflective body extending to the same side to which the light-emergent face extends from vicinity of an area straightly over the light source unit, the first reflective body having a first reflective face configured to be closer to the light-emergent face as the first reflective body extends from the vicinity of the area straightly over the light source unit; and a second reflective body extending to the same side to which the light-emergent face extends from the vicinity of the area directly under the light source unit over the light-emergent face, the second reflective body having a second reflective face configured to be closer to the light-emergent face as the second reflective body extends from the vicinity of the area straightly under the light source unit.

* * * * *